US007503809B2

(12) United States Patent
Tsai et al.

(10) Patent No.: US 7,503,809 B2
(45) Date of Patent: Mar. 17, 2009

(54) POWER ADAPTER HAVING DETACHABLE POWER CABLE COUPLER HEAD

(75) Inventors: Chung-Ju Tsai, Taoyuan Hsien (TW); Chien-Hua Chiao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/555,527

(22) Filed: Nov. 1, 2006

(65) Prior Publication Data

US 2007/0298664 A1 Dec. 27, 2007

(30) Foreign Application Priority Data

Jun. 26, 2006 (TW) ..... 95123012 A

(51) Int. Cl.
*H01R 24/04* (2006.01)

(52) U.S. Cl. ..... 439/668

(58) Field of Classification Search ..... 439/668, 439/669, 572, 571, 79
See application file for complete search history.

(56) References Cited

U.S. PATENT DOCUMENTS

| | | | | | |
|---|---|---|---|---|---|
| 5,057,971 | A * | 10/1991 | Hautvast et al. | ..... | 361/740 |
| 5,573,423 | A * | 11/1996 | Lin et al. | ..... | 439/462 |
| 6,155,867 | A * | 12/2000 | Chou | ..... | 439/462 |
| 6,520,792 | B2 * | 2/2003 | Chen-Chiang et al. | ..... | 439/373 |
| 2004/0132344 | A1 * | 7/2004 | Plishner | ..... | 439/668 |
| 2004/0242076 | A1 * | 12/2004 | Nakai et al. | ..... | 439/668 |
| 2006/0009082 | A1 * | 1/2006 | Lin | ..... | 439/668 |

* cited by examiner

*Primary Examiner*—Jean F Duverne
(74) *Attorney, Agent, or Firm*—Kirton & McConkie; Evan R. Witt

(57) ABSTRACT

A power adapter includes a main body, a locking member and a power cable coupler head. The main body includes an opening. The locking member is arranged on the main body and includes a perforation, which is communicated with the opening. The power cable coupler head is rotatably and detachably connected to the locking member such that a portion of the power cable coupler head is penetrated through the perforation and the opening to be coupled with the main body.

11 Claims, 10 Drawing Sheets

POWER ADAPTER HAVING DETACHABLE POWER CABLE COUPLER HEAD

FIELD OF THE INVENTION

The present invention relates to a power supply apparatus, and more particularly to a power adapter having a detachable power cable coupler head.

BACKGROUND OF THE INVENTION

Power adapters are essential for many electronic devices such as notebook computers or mobile phones. Generally, the user may simply plug an AC plug of a power adapter into an AC wall outlet commonly found in most homes or offices so as to receive an AC voltage. The power adapter will convert the AC voltage into a regulated DC output voltage for powering the electronic device and/or charging a battery built-in the electronic device.

Referring to FIG. 1(*a*), a schematic perspective view of a conventional power adapter to be used in a notebook computer is illustrated. The power adapter of FIG. 1(*a*) comprises a main body 11, an AC power cable 12, an AC inlet 13, a DC power cable 14 and a DC plug 15. The AC inlet 13 is connected to the input terminal of the main body 11 for receiving an AC voltage from an external power source. The DC plug 15 is connected to the output terminals of the main body 11. After the DC plug 15 is inserted into a power receiving slot 161 of an electronic device 16 such as a notebook computer, the AC voltage transmitted from the external power source is converted by the circuitry of a printed circuit board inside the main body 11 into regulated DC output voltages and transmitted to the electronic device 16 through the DC power cable 14 and the DC plug 15.

Please refer to FIG. 1(*b*), which is a partial schematic exploded view of the power adapter of FIG. 1(*a*). The power adapter includes an upper cover 111, a lower cover 112 and a circuit board 113. A closed space is defined between the upper cover 111 and the lower cover 112 for accommodating therein the circuit board 113. An end of the DC power cable 14 includes a coupler head 141 and two conductive terminals 142 serving as positive and negative electrodes. For assembling the power adapter 11, the circuit board 113 is received in the lower cover 112, and then the conductive terminals 142 of the DC power cable 14 are coupled to the circuit board 113. Then, the upper cover 111 is combined with the lower cover 112 by using for example an ultrasonic welding operation or a fastening operation. When the upper cover 111 and the lower cover 112 are combined together, the first notch 1110 of the upper cover 111 and the second notch 1120 of the lower cover 112 are sheathed around a receiving portion 143.

By means of the power adapter 11, the regulated DC output voltages will be transmitted to the electronic device 16 through the DC power cable 14 and the DC plug 15. However, a special consideration should be taken to secure the DC power cable 14. As shown FIG. 1(*c*), a strap 17 is used to secure a bundled DC power cable 14 for storage. Under this circumstance, a bent portion 18 is readily formed at the interface between the output terminals of the main body 11 and the DC power cable 14. Generally, the bundled DC power cable 14, which is suspended over the main body 11, results in an inferior appearance and occupies a lot of space.

In views of the above-described disadvantages resulted from the prior art, the applicant keeps on carving unflaggingly to develop a power adapter having a detachable power cable coupler head according to the present invention through wholehearted experience and research.

SUMMARY OF THE INVENTION

It is an object of the present invention to provide a power adapter having a power cable coupler head, which is detachably coupled to the main body of the power adapter, so as to facilitate effective storage.

It is another object of the present invention to provide a power adapter having a power cable coupler head, which is firmly secured to the main body of the power adapter, so as to avoid abrupt power interruption.

In accordance with a first aspect of the present invention, there is provided a power adapter. The power adapter includes a main body, a locking member and a power cable coupler head. The main body includes an opening. The locking member is arranged on the main body and includes a perforation, which is communicated with the opening. The power cable coupler head is rotatably and detachably connected to the locking member such that a portion of the power cable coupler head is penetrated through the perforation and the opening to be coupled with the main body.

In accordance with a second aspect of the present invention, there is provided a power adapter. The power adapter includes a main body, a locking member and a power cable coupler head. The main body includes an opening. The locking member is arranged on the main body and includes a first locking part and a second locking part, which have a first recess and a second recess, respectively. A gap and a perforation are defined between the first locking part and the second locking part, wherein the perforation is communicated with the opening. The power cable coupler head includes a first protrusion element and a second protrusion element to be embedded within the first recess and the second recess, respectively, such that the power cable coupler head is penetrated through the perforation and the opening to be detachably coupled with the main body.

In accordance with a third aspect of the present invention, there is provided a power adapter. The power adapter includes a main body, a locking member and a power cable coupler head. The main body includes an opening. The locking member is arranged on the main body and includes a perforation. The perforation is communicated with the opening. An inner thread is formed on the inner wall of the perforation of the locking member. The power cable coupler head has an external thread mating with the inner thread of the locking member such that a portion of the power cable coupler head is penetrated through the perforation and the opening to be detachably coupled with the main body.

The above contents of the present invention will become more readily apparent to those ordinarily skilled in the art after reviewing the following detailed description and accompanying drawings, in which:

BRIEF DESCRIPTION OF THE DRAWINGS

FIG. 1(*b*) is a partial schematic exploded view illustrating the power adapter of FIG. 1(*a*);

FIG. 1(*c*) is a schematic assembled view of the power adapter;

FIG. 2(*b*) is a schematic assembled view of the power adapter shown in FIG. 2(*a*);

FIG. 2(*c*) is a partial schematic cross-sectional view of the power adapter shown in FIG. 2(*b*);

FIG. 2(*d*) is a partial schematic cross-sectional view illustrating the assembled power adapter;

FIG. 2(*e*) is a schematic perspective view illustrating the assembled power adapter;

FIG. 3(*b*) is a partial schematic cross-sectional view of the power adapter shown in FIG. 3(*a*);

FIG. 3(*c*) is a partial schematic cross-sectional view illustrating the assembled power adapter shown in FIG. 3(*a*); and FIG. 3(*d*) is a schematic perspective view illustrating the assembled power adapter shown in FIG. 3(*a*).

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
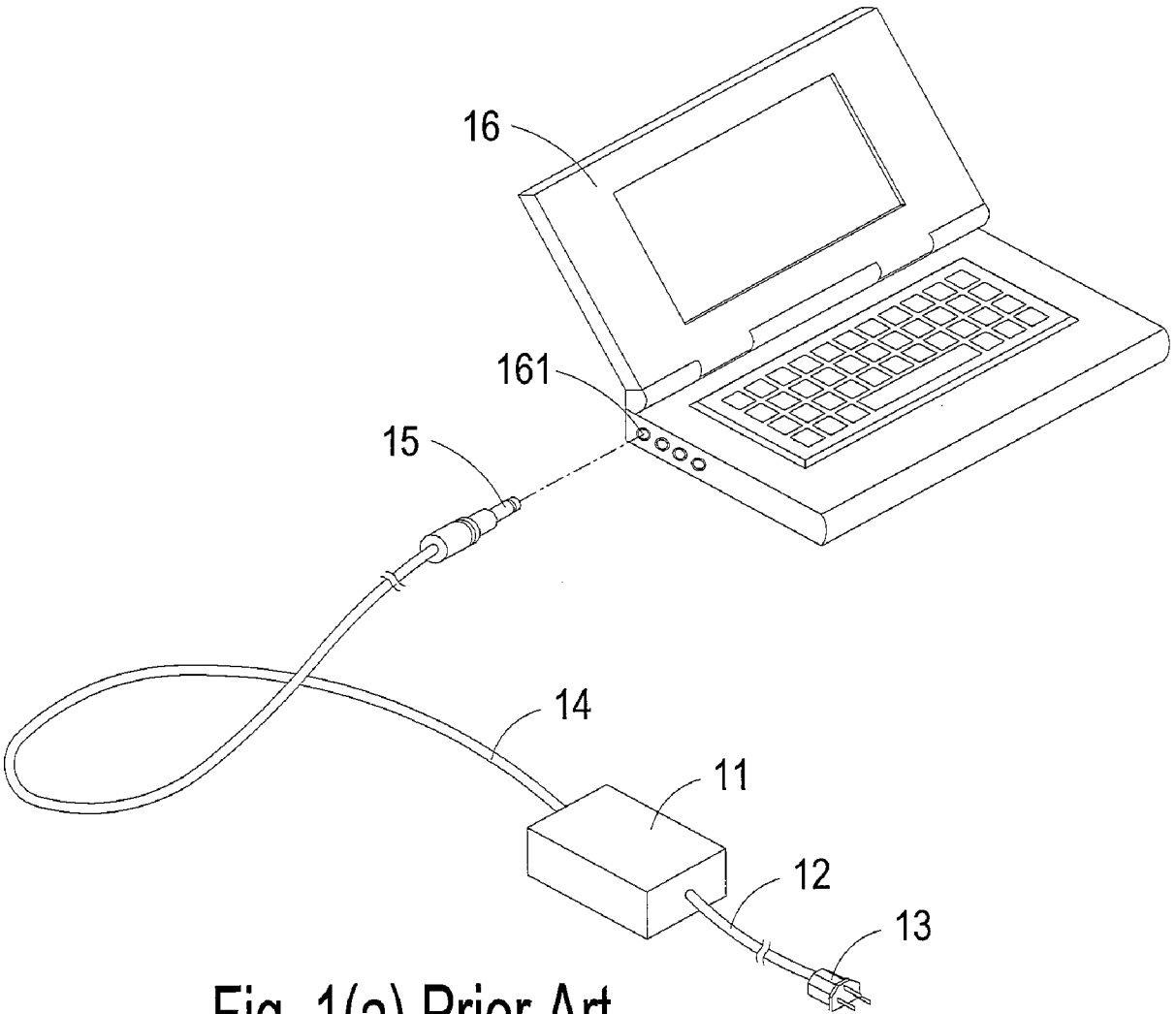
Fig. 1(a) Prior Art
FIG. 1(*a*) is a schematic perspective view of a conventional power adapter to be used in a notebook computer.
Figure 1B:
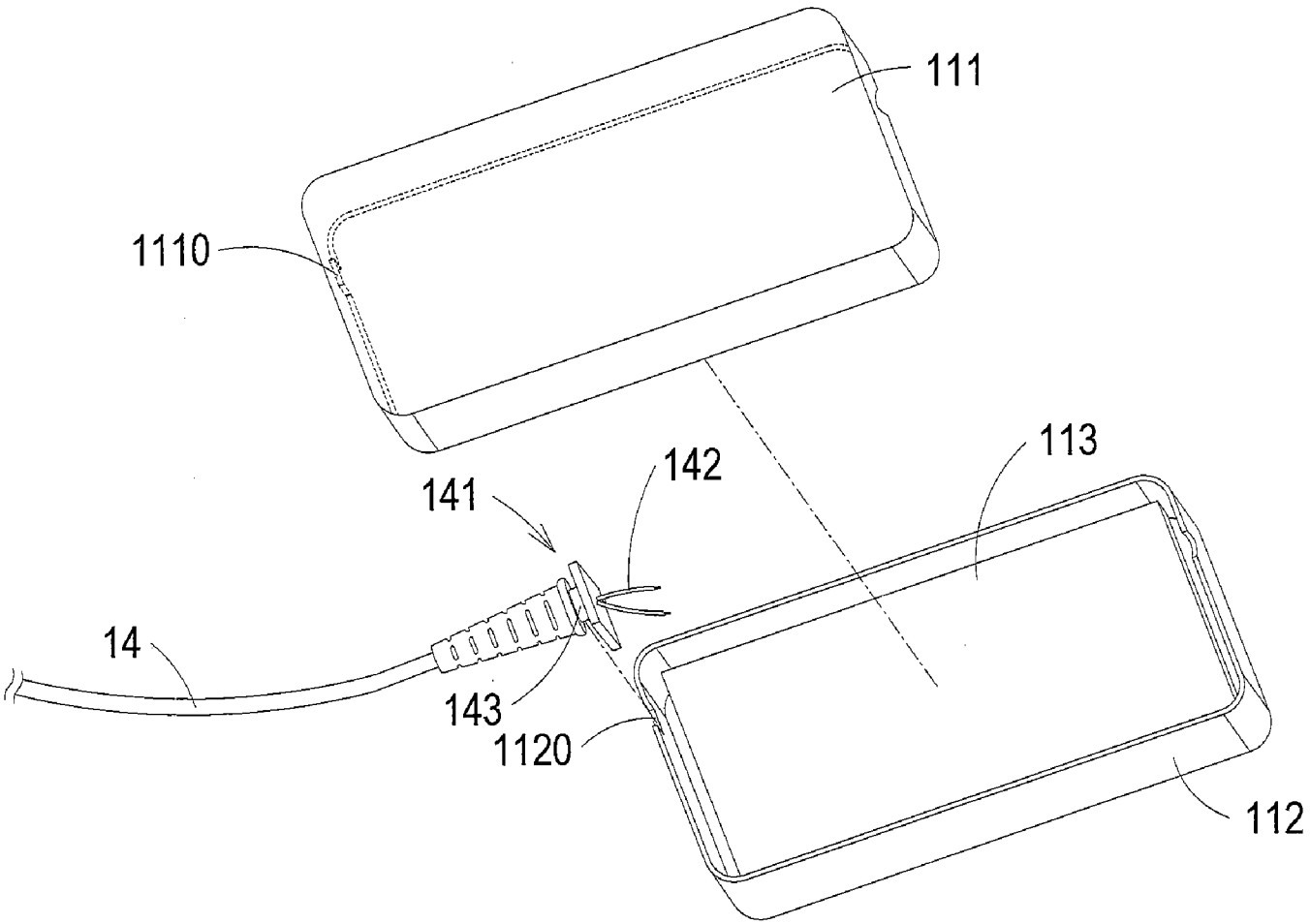
Fig. 1(b) Prior Art
Figure 1C:
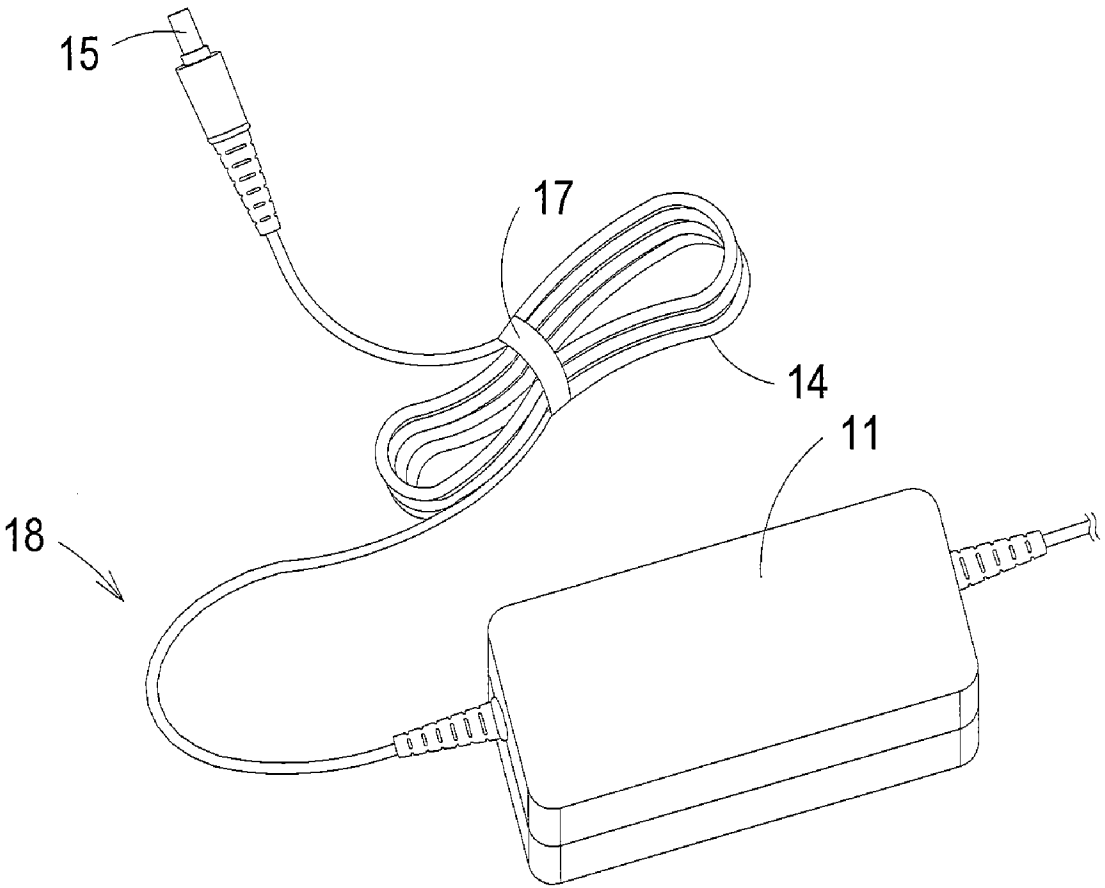
Fig. 1(c) Prior Art
Figure 2A:
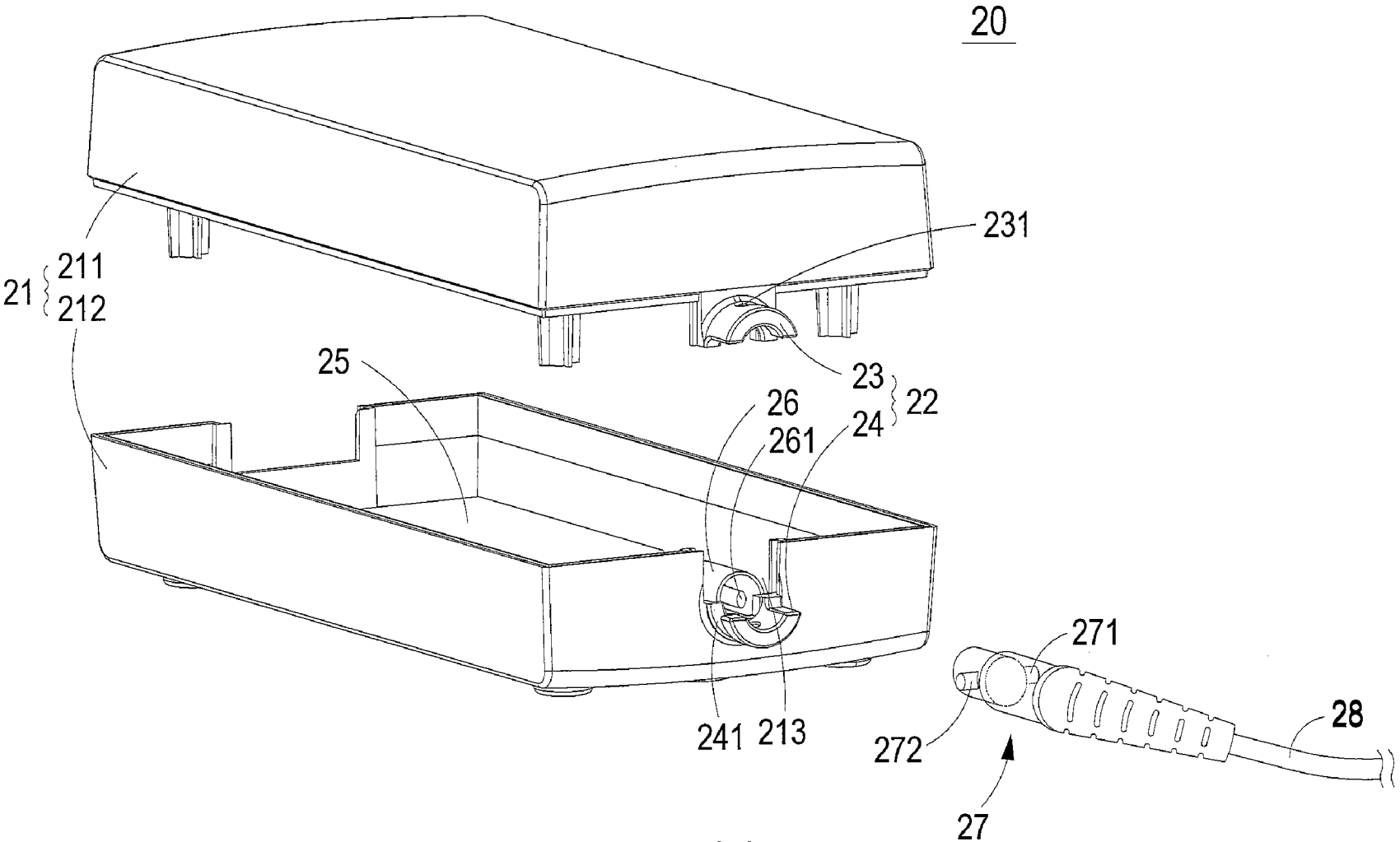
FIG. 2(*a*) is a schematic exploded view of a power adapter according to a preferred embodiment of the present invention.
Figure 2B:
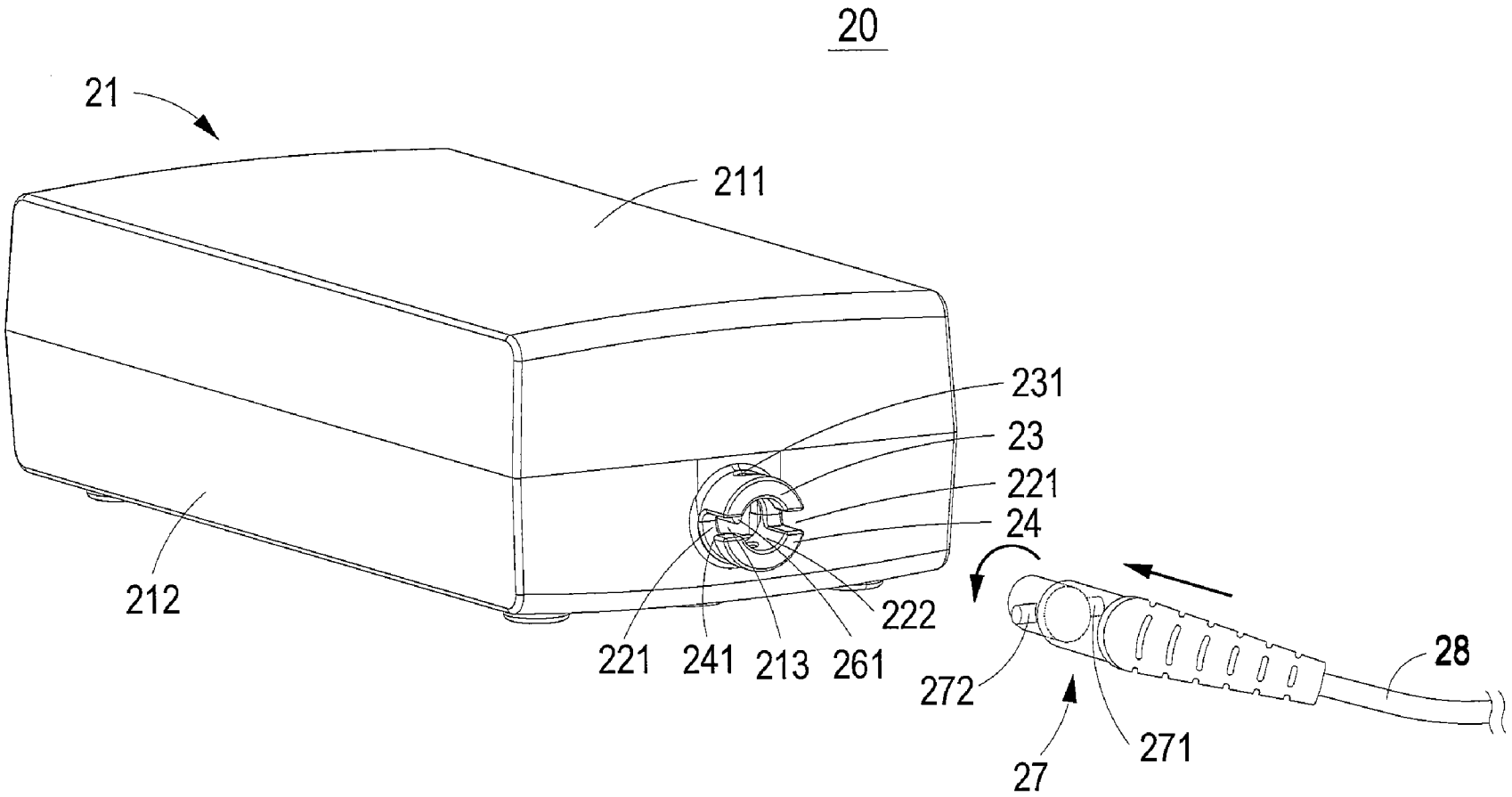
Figure 2D:
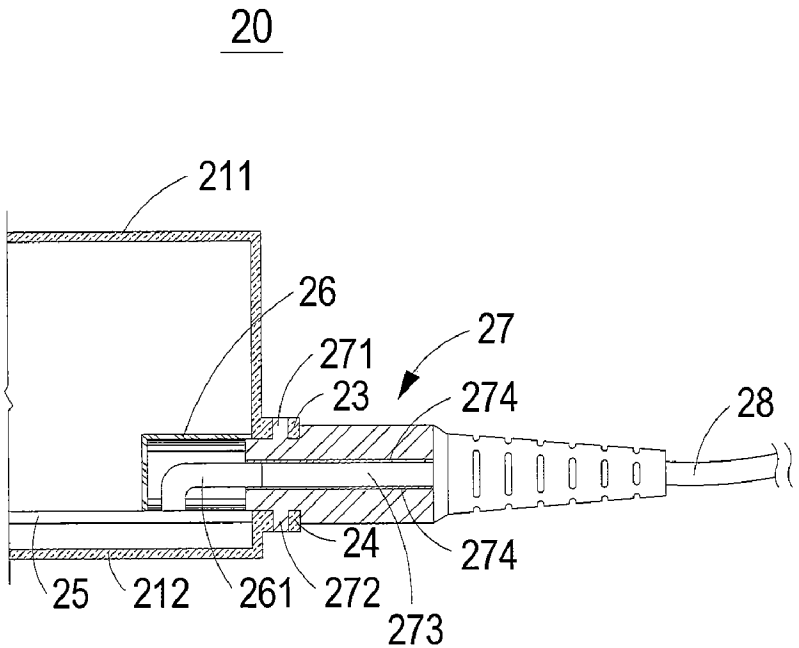
Figure 2C:
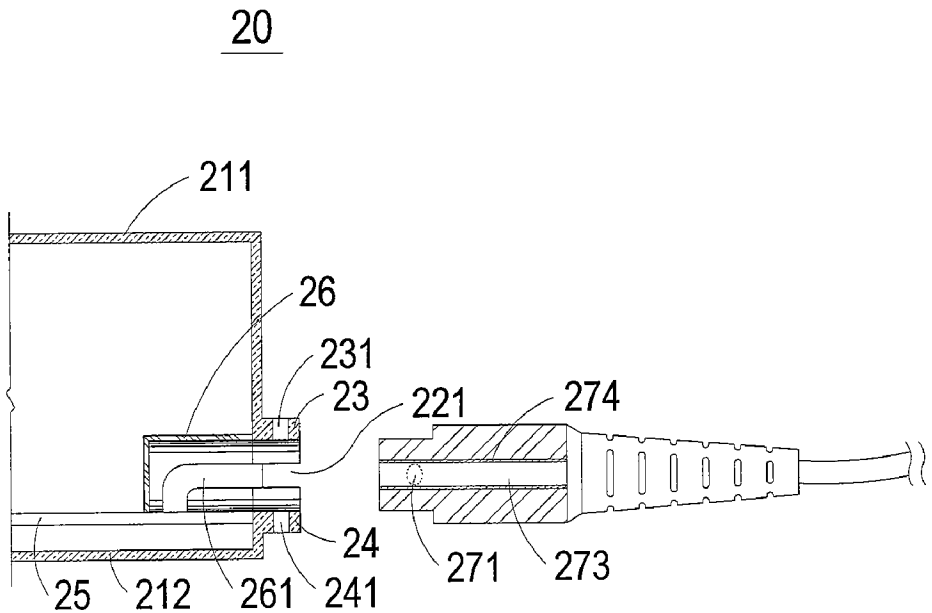
Figure 2E:
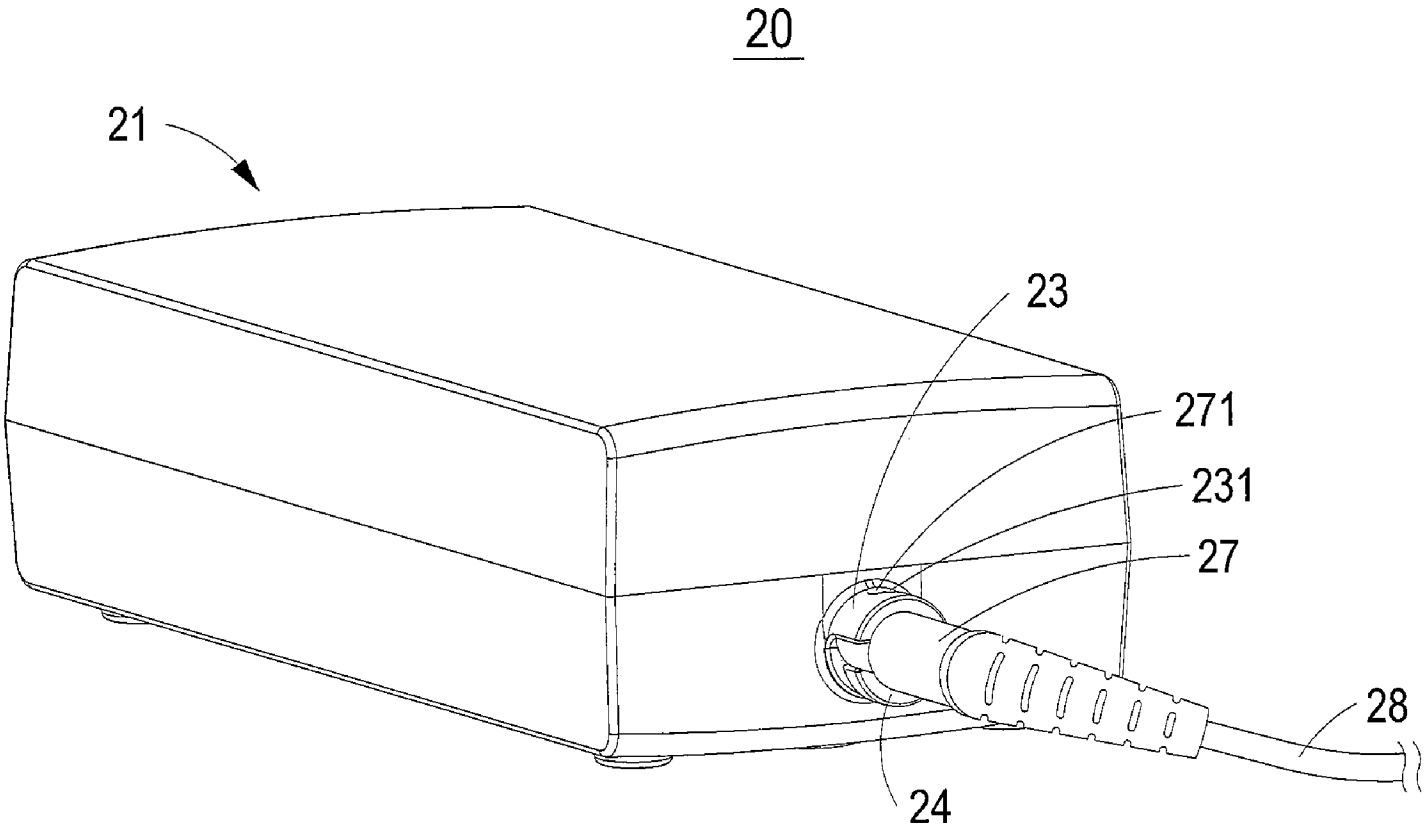

Referring to FIG. 2(*a*), a schematic exploded view of a power adapter according to a preferred embodiment of the present invention is illustrated. The power adapter 20 of FIG. 2(*a*) comprises a main body 21, a locking member 22, a circuit board 25 and a power cable coupler head 27. The main body 21 includes a first cover 211 and a second cover 212. As shown in FIG. 2(*b*), when the first cover 211 and the second cover 212 are combined together by using for example an ultrasonic welding operation or a fastening operation, a closed space is defined between the first cover 211 and the second cover 212 for accommodating the circuit board 25 therein. In addition, the main body 21 has an opening 213 corresponding to the power cable coupler head 27.

A socket 26 is mounted on the circuit board 25 and faces to the opening 213 of the main body 21. The socket 26 has a hollow portion, and a conductive terminal 261 is received within the hollow portion. An end of the conductive terminal 261 is electrically connected to the circuit board 25 (as is shown in FIG. 2(*c*)), and the other end of the conductive terminal 261 is electrically connected to the power cable coupler head 27. The AC voltage transmitted from the external power source is converted by the circuitry of the printed circuit board 25 into regulated DC output voltages and transmitted to the electronic device (not shown).

In some embodiments, the locking member 22 includes a first locking part 23 and a second locking part 24. Preferably, the first locking part 23 and the second locking part 24 are integrally formed on the first cover 211 and the second cover 212, respectively. The first locking part 23 and the second locking part 24 of the locking member 22 have a first recess 231 and a second recess 241, respectively. When the first cover 211 and the second cover 212 are combined together, a perforation 222 is formed. In addition, a gap 221 is formed between the first locking part 23 and the second locking part 24 of the locking member 22.

FIG. 2(*c*) is a partial schematic cross-sectional view of the power adapter shown in FIG. 2(*b*). FIG. 2(*d*) is a partial schematic cross-sectional view illustrating the assembled power adapter. As shown in FIG. 2(*c*) and FIG. 2(*d*), the power cable coupler head 27 is a hollow tube having a first end coupled to a power cable 28 and a second end detachably coupled to the first locking part 23 and the second locking part 24 of the locking member 22. The power cable coupler head 27 has a first protrusion element 271 and a second protrusion element 272 disposed on opposite sides thereof. The power cable coupler head 27 further includes a receiving part 273 corresponding to the conductive terminal 261 of the socket 26. A conducting part 274 is disposed on the inner wall of the power cable coupler head 27 to be electrically connected to the conductive terminal 261 of the socket 26.

Please refer to FIGS. 2(*b*), 2(*c*) and 2(*d*). The locking member 22 is detachably coupled to the power cable coupler head 27 by rotation. Firstly, the power cable coupler head 27 is inserted into the perforation 222 such that the first protrusion element 271 and the second protrusion element 272 are in contact with the connecting portions between the first locking part 23, the second locking part 24, the first cover 211 and the second cover 212. Then, the power cable coupler head 27 is rotated such that the first protrusion element 271 is rotated to the first recess 231 of the first locking part 23 and the second protrusion element 272 is rotated to the second recess 241 of the second locking part 24. The widths of the first recess 231 and the second recess 241 are substantially identical to the outer diameters of the first protrusion element 271 and the second protrusion element 272. After the first protrusion element 271 and the second protrusion element 272 are rotated to the terminals of the first recess 231 and the second recess 241, the power cable coupler head 27 is firmly secured to the locking member 22, as is shown in FIG. 2(*e*). Meanwhile, the conducting part 274 of the power cable coupler head 27 is electrically connected to the conductive terminal 261 of the socket 26, thereby transmitting the AC voltage from the power cable 28 to the circuit board 25 in a case that the power cable 28 is an AC power cable. Alternatively, in a case that the power cable 28 is a DC power cable, the DC output voltage regulated by the circuit board 25 will be transmitted to the electronic device through the power cable 28. Since the power cable coupler head 27 is firmly secured to the locking member 22, the power cable coupler head 27 is not easily separated from the main body 21 in response to an external force if the power adapter 20 is hung on the wall, thereby avoiding abrupt power interruption.

In a case that the power adapter 20 is not used or needs to be carried for travel, the power cable coupler head 27 should be rotated in a reverse direction such that the first protrusion element 271 and the second protrusion element 272 are detached from the first locking part 23 and the second locking part 24. In other words, the first protrusion element 271 and the second protrusion element 272 are switched from the first recess 231 of the first locking part 23 and the second recess 241 of the second locking part 24 to the gap 221. After the power cable coupler head 27 is pulled out of the main body 21, the power cable coupler head 27 is separated from the locking member 22. Under this circumstance, the power cable 28 can be stored for portability and saving space.

Figure 3A:
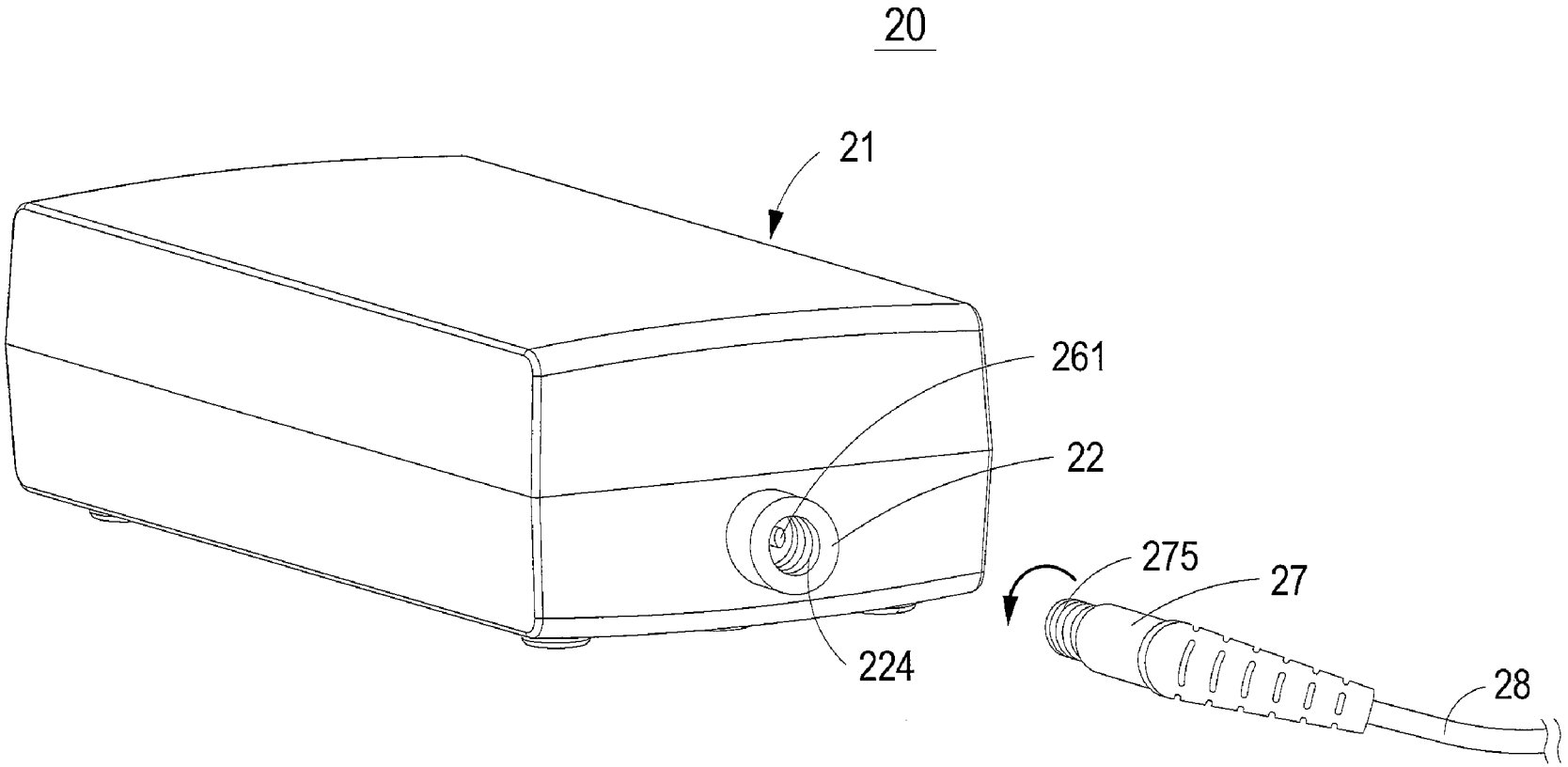
FIG. 3(*a*) is a schematic perspective view of a power adapter according to another preferred embodiment of the present invention.
Figure 3C:
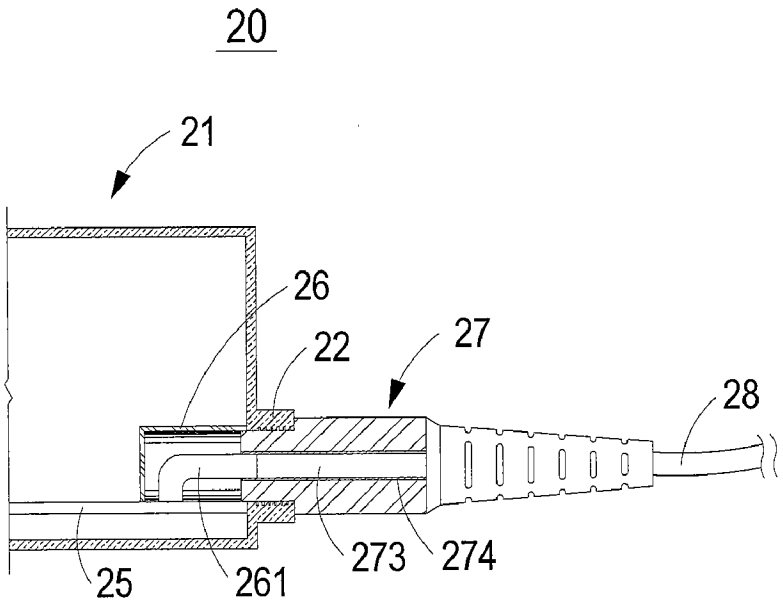
Figure 3B:
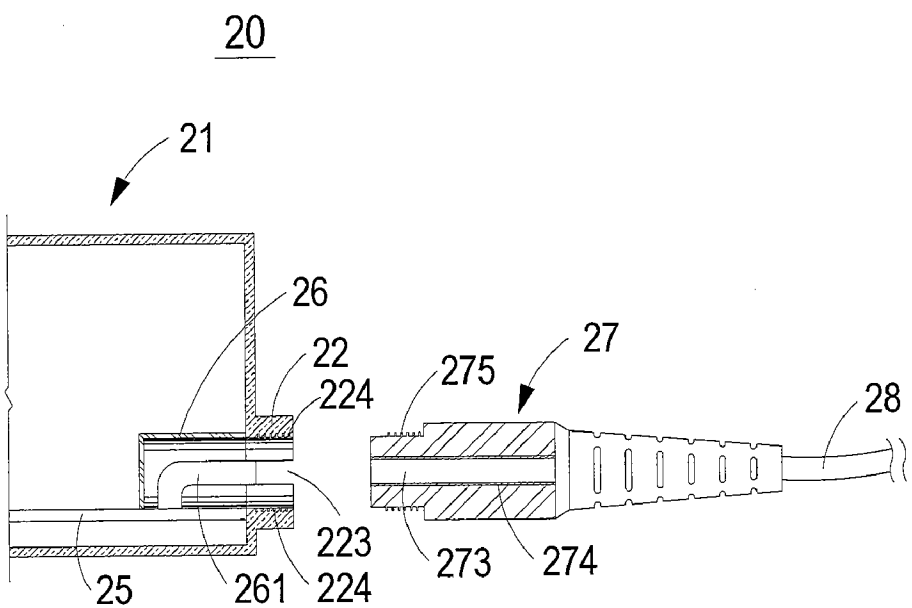
Figure 3D:
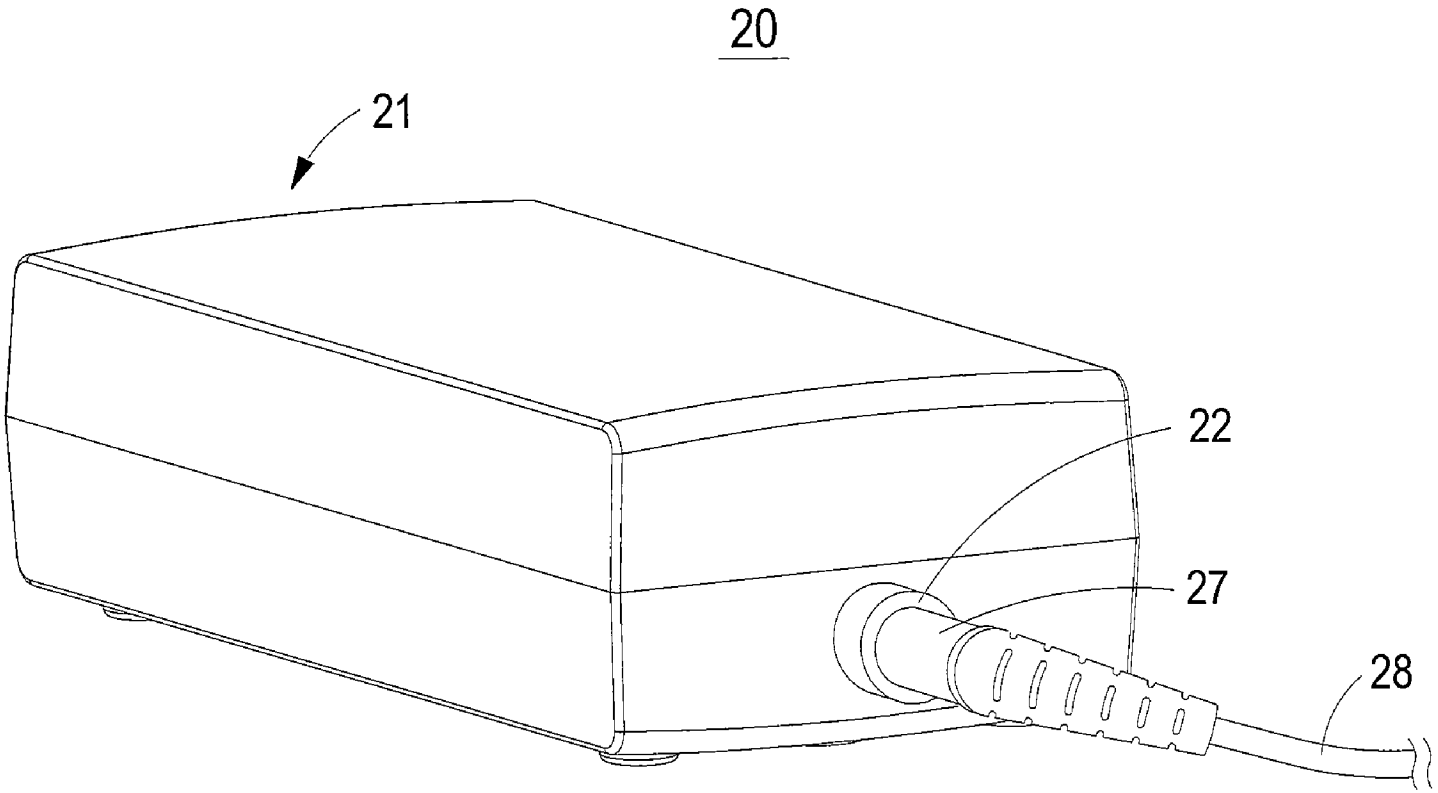

A further embodiment of a power adapter is illustrated in FIGS. 3(*a*)~3(*d*). In this embodiment, the main body 21, the first cover 211, the second cover 212, the locking member 22, the circuit board 25, the socket 26, the conductive terminal 261 and the power cable coupler head 27 included therein are similar to those shown in FIGS. 2(*a*)~2(*e*), and are not redundantly described herein.

In this embodiment, the locking member 22 is substantially a hollow cylindrical structure including a perforation 223. An inner thread 224 is formed on the inner wall thereof. The perforation 223 is communicated with the conductive terminal 261 of the socket 26. The power cable coupler head 27 is for example a hollow tube having a first end coupled to a power cable 28 and a second end detachably coupled to the locking member 22. The power cable coupler head 27 has an external thread 275 mating with the inner thread 224 of the locking member 22. The power cable coupler head 27 further includes a receiving part 273 corresponding to the conductive terminal 261 of the socket 26. A conducting part 274 is disposed on the inner wall of the power cable coupler head 27 to be electrically connected to the conductive terminal 261 of the socket 26.

The locking member 22 is detachably coupled to the power cable coupler head 27 by rotation. After the power cable coupler head 27 is screwed in the perforation 223, the external thread 275 is engaged with the inner thread 224. Meanwhile, the conducting part 274 of the power cable coupler head 27 is electrically connected to the conductive terminal 261 of the socket 26, thereby transmitting the AC voltage from the power cable 28 to the circuit board 25 in a case that the power cable 28 is an AC power cable. Alternatively, in a case that the power cable 28 is a DC power cable, the DC output voltage regulated by the circuit board 25 will be transmitted to the electronic device through the power cable 28. Since the power cable coupler head 27 is firmly secured to the locking member 22, the power cable coupler head 27 is not easily separated from the main body 21 in response to an external force if the power adapter 20 is hung on the wall, thereby avoiding abrupt power interruption.

In a case that the power adapter 20 is not used or needs to be carried for travel, the power cable coupler head 27 should be rotated in a reverse direction such that the external thread 275 disengages from the inner thread 224. After the power cable coupler head 27 is pulled out of the main body 21, the power cable coupler head 27 is separated from the locking member 22. Under this circumstance, the power cable 28 can be stored for portability and saving space.

From the above description, the power cable coupler head 27 is firmly secured to the locking member 22 by either coupling the first/second protrusion elements with the first/second recesses or engaging the external thread with the inner thread. Since the power cable coupler head 27 is firmly secured to the locking member 22, the power cable coupler head 27 is not easily separated from the main body 21 in response to an external force if the power adapter 20 is hung on the wall, thereby avoiding abrupt power interruption.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power adapter comprising:

a main body including a closed space for accommodating a circuit board therein and an opening;

a locking member arranged on said main body and including a perforation, a first locking part and a second locking part, wherein said perforation is communicated with said opening, said first locking part and said second locking part include a first recess and a second recess, respectively, and a gap is formed between said first locking part and said second locking part;

a power cable coupler head rotatably locked and detachably connected to said locking member such that a portion of said power cable coupler head is penetrated through said perforation and said opening to be coupled with said main body; and a socket mounted on said circuit board and having a conductive terminal received within said socket, wherein one end of said conductive terminal is electrically connected to said circuit board and the other end is electrically connected to said power cable coupler head.

2. The power adapter according to claim 1 wherein said main body includes a first cover and a second cover, and said closed space is defined between said first cover and said second cover.

3. The power adapter according to claim 1 wherein said socket faces to said opening of said main body, and said conductive terminal is directly electrically connected to said circuit board.

4. The power adapter according to claim 1 wherein said power cable coupler head further includes a receiving part to be electrically connected to said conductive terminal.

5. The power adapter according to claim 1 wherein said power cable coupler head further includes a first protrusion element and a second protrusion element to be embedded within said first recess and said second recess, respectively, such that said power cable coupler head is penetrated through said perforation and said opening to be coupled with said main body.

6. The power adapter according to claim 1 wherein an inner thread is formed on the inner wall of said perforation of said locking member.

7. The power adapter according to claim 6 wherein said power cable coupler head has an external thread mating with said inner thread of said locking member.

8. A power adapter comprising:

a main body including a closed space for accommodating a circuit board therein and an opening;

a locking member arranged on said main body and including a first locking part and a second locking part, which have a first recess and a second recess, respectively, and a gap and a perforation are defined between said first locking part and said second locking part, wherein said perforation is communicated with said opening;

a power cable coupler head including a first protrusion element and a second protrusion element to be embedded within said first recess and said second recess, respectively, such that said power cable coupler head is rotatably locked to said locking member and penetrated through said perforation and said opening to be detachably coupled with said main body; and a socket mounted on said circuit board and having a conductive terminal received within said socket, wherein one end of said conductive terminal is electrically connected to said circuit board and the other end is electrically connected to said power cable coupler head.

9. The power adapter according to claim 8 wherein said main body includes a first cover and a second cover, and said closed space is defined between said first cover and said second cover.

10. The power adapter according to claim 8 wherein said socket faces to said opening of said main body, and said conductive terminal-is directly electrically connected to said circuit board.

11. The power adapter according to claim 8 wherein said power cable coupler head further includes a receiving part to be electrically connected to said conductive terminal.

* * * * *